US012193581B2

(12) United States Patent
Hill

(10) Patent No.: US 12,193,581 B2
(45) Date of Patent: Jan. 14, 2025

(54) MOUNTING DEVICE AND METHOD

(71) Applicant: Jayson Hill, Castle Rock, CO (US)

(72) Inventor: Jayson Hill, Castle Rock, CO (US)

( * ) Notice: Subject to any disclaimer, the term of this patent is extended or adjusted under 35 U.S.C. 154(b) by 0 days.

(21) Appl. No.: 17/899,306

(22) Filed: Aug. 30, 2022

(65) Prior Publication Data

US 2023/0110622 A1 Apr. 13, 2023

Related U.S. Application Data

(60) Provisional application No. 63/277,985, filed on Nov. 10, 2021, provisional application No. 63/239,891, filed on Sep. 1, 2021.

(51) Int. Cl.
*A47G 1/16* (2006.01)
*A47G 1/17* (2006.01)

(52) U.S. Cl.
CPC ..... *A47G 1/1613* (2013.01); *A47G 1/17* (2013.01)

(58) Field of Classification Search
CPC ..... A47G 1/1613; A47G 1/17; A47G 1/1606; F16M 13/00
USPC ..... 248/467, 470, 489, 495, 496, 498, 544, 248/547
See application file for complete search history.

(56) References Cited

U.S. PATENT DOCUMENTS

D112,534 S 12/1938 Olszewski et al.
D181,474 S 11/1957 Antonio
D243,510 S 3/1977 Shirey et al.
4,228,982 A * 10/1980 Sellera ..... A47G 1/1606 248/467
4,437,639 A * 3/1984 Stein ..... F16M 11/105 248/558
D275,868 S 10/1984 Ake
D280,433 S 9/1985 Lincir
D361,260 S * 8/1995 Trentham ..... D8/373
6,880,259 B1 4/2005 Schultz
D506,919 S * 7/2005 Munson ..... D8/373
8,333,026 B2 12/2012 Southard
9,183,006 B2 11/2015 Turcotte et al.
9,215,941 B1 * 12/2015 Kressin ..... G11B 33/0427
9,279,538 B1 3/2016 Wening
9,395,044 B2 7/2016 Cheng
D821,188 S 6/2018 Smullen
10,307,001 B1 6/2019 Fitzpatrick
(Continued)

FOREIGN PATENT DOCUMENTS

JP 2004-305723 A 11/2004
JP 2018075354 A 5/2018
(Continued)

OTHER PUBLICATIONS

"International Search Report and Written Opinion for International Application No. PCT/US2022/030776, Search completed on Sep. 16, 2022 Mailed on Sep. 16, 2022."
(Continued)

*Primary Examiner* — Muhammad Ijaz
(74) *Attorney, Agent, or Firm* — Kutak Rock LLP; Neil Arney; Brian L. Main

(57) ABSTRACT

The present invention relates to a device and method for mounting a framed image, such as a canvas painting stretched across a wooden frame, on a wall or other mounting surface by using the back edge of the frame and a mounting device to mount the framed image flush to the mounting surface.

7 Claims, 9 Drawing Sheets

(56) References Cited

U.S. PATENT DOCUMENTS

| | | | | |
|---|---|---|---|---|
| 10,331,319 | B2 | 6/2019 | Travis et al. | |
| D950,656 | S | 5/2022 | Andersson | |
| 11,690,464 | B2 | 7/2023 | Spiro et al. | |
| D1,018,733 | S | 3/2024 | Cardona | |
| 2006/0186306 | A1* | 8/2006 | Castle | A47G 1/215 248/494 |
| 2015/0208835 | A1 | 7/2015 | Floyd et al. | |
| 2017/0055732 | A1 | 3/2017 | Krake et al. | |
| 2017/0200286 | A1 | 7/2017 | Brahmanapalli et al. | |
| 2019/0024370 | A1 | 1/2019 | Wiggins | |
| 2019/0045948 | A1 | 2/2019 | Gale | |
| 2022/0000287 | A1* | 1/2022 | Levis | F16M 11/16 |

FOREIGN PATENT DOCUMENTS

| | | | |
|---|---|---|---|
| KR | 10-2012-0000275 | A | 1/2012 |
| KR | 10-20140007220 | A | 1/2014 |

OTHER PUBLICATIONS

"International Search Report and Written Opinion for International Application No. PCT/US2022/042060, Search completed on Dec. 16, 2022, Mailed on Dec. 16, 2022."

"Ex Parte Quayle Action Received for Design U.S. Appl. No. 29/851,968, mailed on Jul. 1, 2024".

"Non-Final Office Action Received for U.S. Appl. No. 17/752,720, mailed on Sep. 16, 2024."

"Restriction Requirement Received for U.S. Appl. No. 17/984,953, mailed on Aug. 27, 2024."

* cited by examiner

MOUNTING DEVICE AND METHOD

CROSS-REFERENCE TO RELATED APPLICATIONS

This application claims priority pursuant to 35 U.S.C. 119(e) to U.S. Provisional Patent Application, Ser. No. 63/239,891, filed Sep. 1, 2021, the entire disclosures of which are incorporated herein by reference.

This application claims priority pursuant to 35 U.S.C. 119(e) to U.S. Provisional Patent Application, Ser. No. 63/277,985, filed Nov. 10, 2021, the entire disclosures of which are incorporated herein by reference.

FIELD OF INVENTION

The present invention relates to a device and method for mounting a framed image on a vertical surface.

BACKGROUND

Framed images are a popular medium used for photographs, paintings, prints, artwork, decorations, wall hangings, or other framed images (collectively "framed images").

There are various methods and devices on the market that can be utilized to mount framed images, including methods utilizing hooks, wires, pins, nails, adhesives, or a combination thereof. The known methods, however, have significant limitations in mounting a framed image at precise locations and in keeping the framed image level. Many known mounting devices for framed images typically involve locating multiple points on the mounting surface and attaching the image at such multiple locations, making it difficult to mount and level the framed image. Other known devices require multiple attachments to the framed image (for example a wire hanging system), which lack stability and make it difficult to keep the framed image level after mounting. The known methods also do not allow for a framed image to be mounted flush to the vertical mounting surface such as a wall. Thus, what is needed is a device and method for easily mounting a framed image using a single mounting bracket attached to the mounting surface and a singular connection between the mounting bracket and the framed image that provides a stable and secure mounting whereby the framed image is maintained as level and flush to a mounting surface.

SUMMARY OF INVENTION

The following summary is provided to facilitate an understanding of some of the innovative features unique to the present invention. The present invention is not intended to be limited by this summary.

The present invention relates to a device and method for mounting a framed image on a wall or other vertical surface. The device and method of the present invention can be used to mount any framed image that has an underside edge or lip at the top, back side of the image. The device and method of the present invention can be used with framed images that have frames made of wood, metal, plastic, or other rigid material provided the top of the frame on the back has an underside lip or edge. By way of example, canvas paintings or prints generally comprise a wooden frame that is square or rectangular with the canvas pulled tight and attached to the frame (herein a "canvas image"). The frame on the back of the canvas image at the top has an underside edge or lip. The present invention utilizes that underside edge or lip in mounting a canvas image and other framed images.

In a preferred embodiment, the mounting device of the present invention comprises a mounting interface that is removably affixed to the underside edge or lip of the top back frame of the framed image. The mounting interface is affixed at the center point on the top back frame of the canvas image or other framed image. The interface is affixed using known adhesives or fasteners. The mounting device also comprises a mounting plate that is removably affixed to the mounting surface using adhesive and/or known fasteners. The center of the mounting plate has a bulls-eye like opening with targeting guides for ease of locating a predetermined mark on the mounting surface and for placing the center of the mounting plate over such predetermined mark. In one embodiment, the middle section of the mounting plate facing away from the mounting surface has threads, forming a male fastener onto which a retaining nut can be screwed. A mounting bracket is removably attached to the mounting plate using the retaining nut to secure the mounting bracket in place. The mounting bracket has a means for leveling the bracket. The top of the mounting bracket forms a receptacle for the mounting interface affixed to the back of the framed image. In a preferred embodiment, the receptacle and the mounting interface are engineered to form a mechanical connection when fitted together to keep the framed image in place on the mounting bracket. One example of a mechanical connection is one or more interconnecting clips machined into the receptacle and the mounting interface. In other embodiments, adhesives, fasteners, Velcro or other known means are used to keep the mounting interface connected in the receptacle. When the mounting interface attached to a framed image is affixed into a level receptacle of the mounting bracket, the framed image is level and is mounted flush to the wall or other mounting surface.

In a preferred embodiment, a rubber seal is placed between the mounting plate and the mounting bracket before the retaining nut secures the mounting bracket to the mounting plate to prevent the mounting bracket from moving on the mounting plate. Other tactile material or other means for creating friction between the mounting plate and the mounting bracket may be used to prevent the mounting bracket from twisting or moving on the mounting plate.

In another embodiment, the mounting plate and mounting bracket are fixedly coupled and removably affixed to the mounting surface as a single unit.

In a preferred embodiment of the present invention the size of the mounting plate, the mounting bracket, the receptacle, and the mounting interface are determined based on the size and weight of the framed image. A framed image that is larger and heavier may require a larger mounting plate and bracket. A heavy image may also require the use of mechanical fasteners to removably affix the mounting plate to a wall or other mounting surface. The use of a mechanical fastener may better support the weight of an image.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DESCRIPTION OF DRAWINGS

The accompanying figures are incorporated herein and form a part of the specification for the present invention and further illustrate the present invention. The figures represent embodiments of the present invention. They do not represent all embodiments of the present invention.

DETAILED DESCRIPTION OF INVENTION

Figure 1:
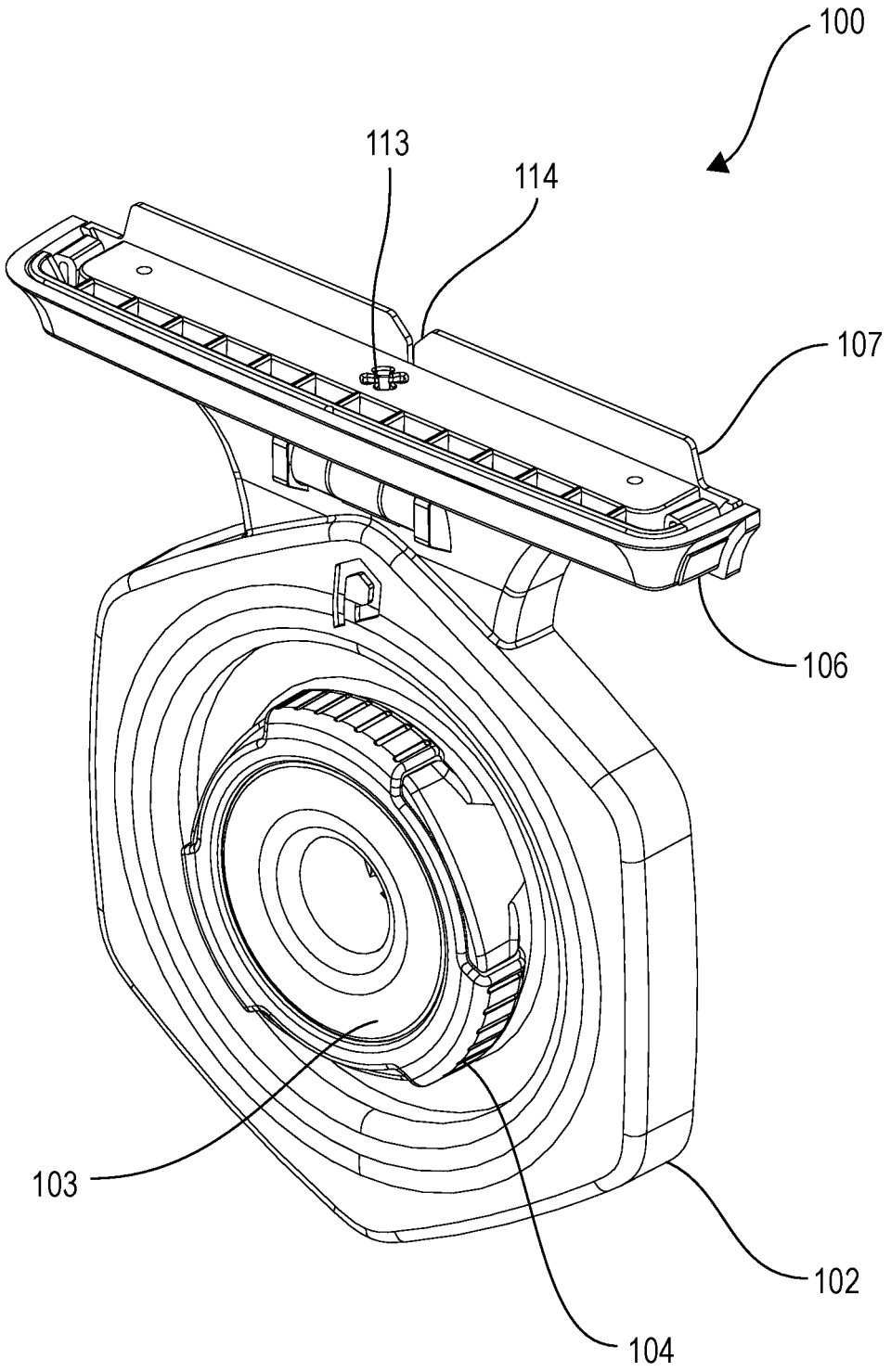
FIG. 1 is a perspective view of an embodiment of the mounting device of the present invention.

The present invention is best understood by reference to the detailed drawings and description set forth herein. Embodiments of the invention are discussed below with reference to the drawings. However, those skilled in the art will readily appreciate that the detailed description given herein with respect to the drawings is for explanatory purposes as the invention extends beyond the limited embodiments described. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number for a claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations. However, the use of such phrases should not be construed to imply a claim recitation by the indefinite articles "a" or "an" limits any particular claim containing such claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of claim recitations is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Throughout this disclosure, examples will be provided for using the mounting device and method disclosed. However, those of skill in the art will appreciate additional applications for the mounting device and method. Uses of the present invention may relate to, for example, mounting one or more prints, pictures, photographs, collages, wall art, artwork, or other images on a wall or other vertical surface.

Figure 7:
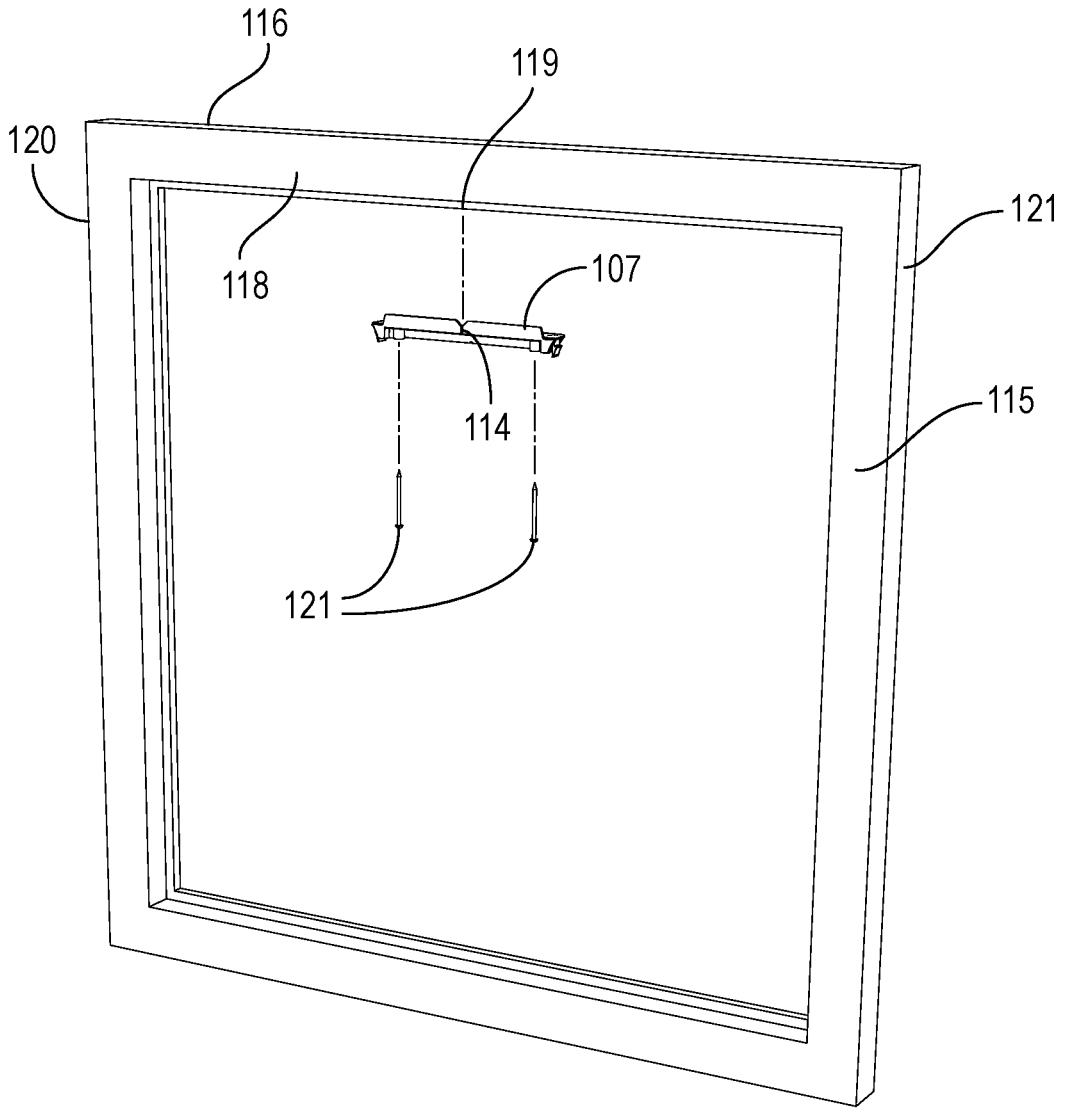
FIG. 7 is a perspective view of the back of a framed image showing an edge or lip formed by the frame and a mounting interface being affixed to the top back edge of the frame of the framed image.

To illustrate embodiments of the present invention, reference is made to the drawings. FIG. 1 shows an embodiment of the mounting device 100 for mounting a framed image, such as a canvas image, on a wall or other mounting surface. In the exploded view of this embodiment presented in FIG. 2, the mounting device 100 comprises a mounting plate 101 and a mounting bracket 102 that can be coupled and uncoupled. The mounting plate 101 has a mid-section 103 onto which the mounting bracket 102 fits. The mid-section 103 of the mounting plate 101 is threaded to receive a retaining nut 104 for coupling and securing the mounting bracket 102 onto the mounting plate 101. In this embodiment, a rubber gasket 105 is placed between the mounting plate 101 and the mounting bracket 102 to create friction and prevent the mounting bracket 102 from rotating or moving on the mounting plate 101 accidentally or inadvertently once secured by the retaining nut 104. The top section of the mounting bracket 102 forms a receptacle 106 that is engineered to receive the mounting interface 107 that is affixed to the back of a framed image. The mounting interface 107 is removably affixed to the framed image on the back and at the top of the framed image as shown in FIG. 7.

Figure 3A:
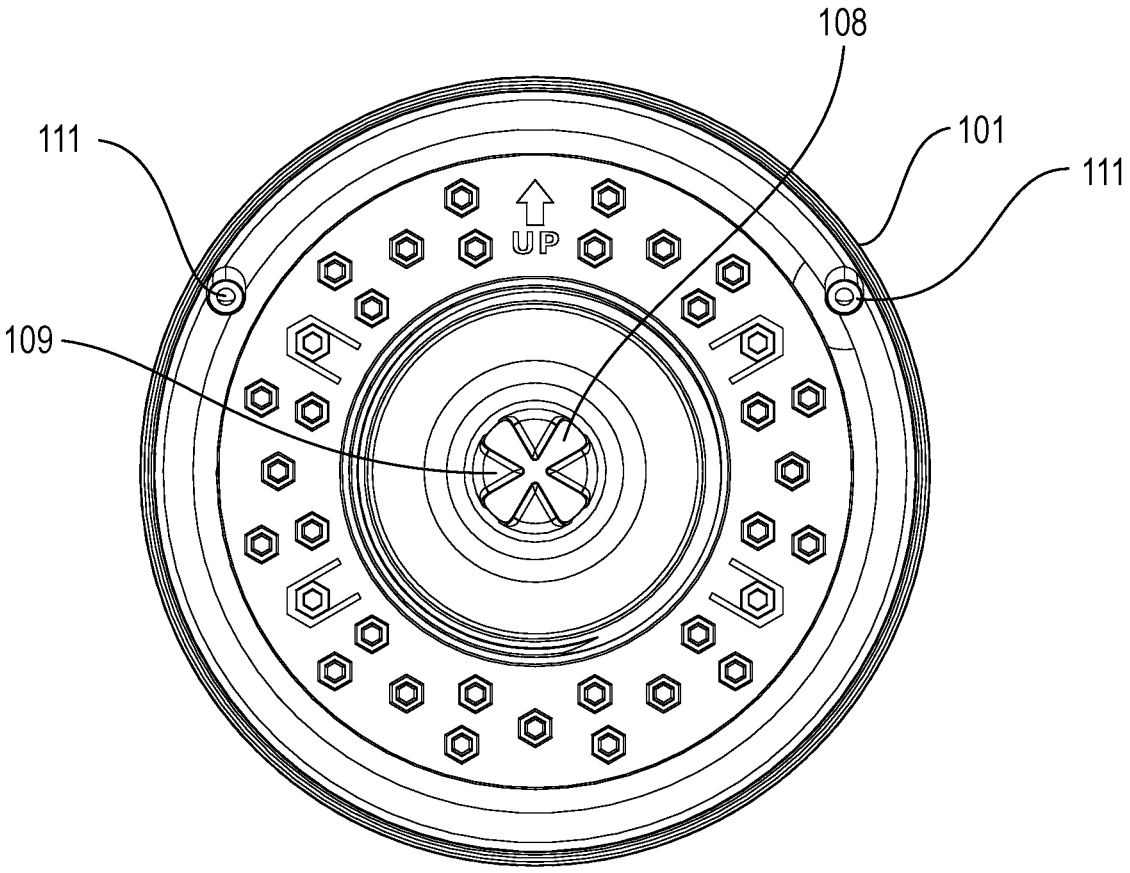
FIGS. 3*a* and 3*b* are a front view and a side view of an embodiment of a mounting plate for the mounting device of the present invention.
Figure 3B:
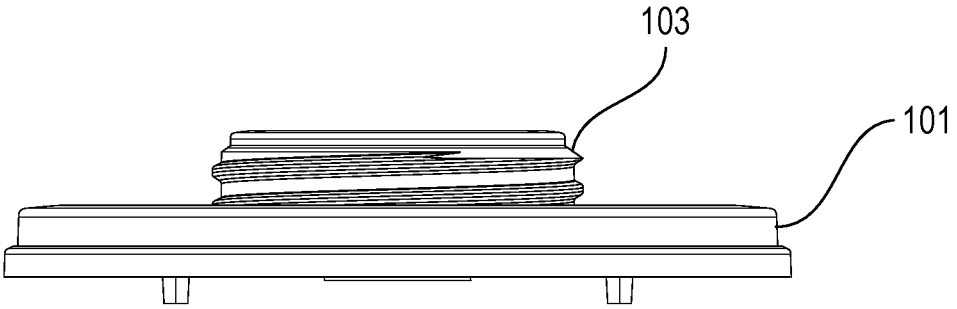

In an embodiment shown in FIG. 3, the center of the mounting plate 101 has a bulls-eye like opening 108 with targeting guides 109 that allow the mounting plate 101 to be centered over a predetermined mark on a wall or other mounting surface. The use of the targeting guides 109 within the bulls-eye like opening 108 allows for the opening to be larger making it easier to locate the predetermined mark on the wall and to aide in placing the center of the mounting plate 101 over the predetermined mark. In a preferred embodiment, the targeting guides 109 are arrow shaped pointing to the center of the mounting device, but the targeting guides 109 may take other shapes that identify the center of the mounting plate 101.

Figure 2:
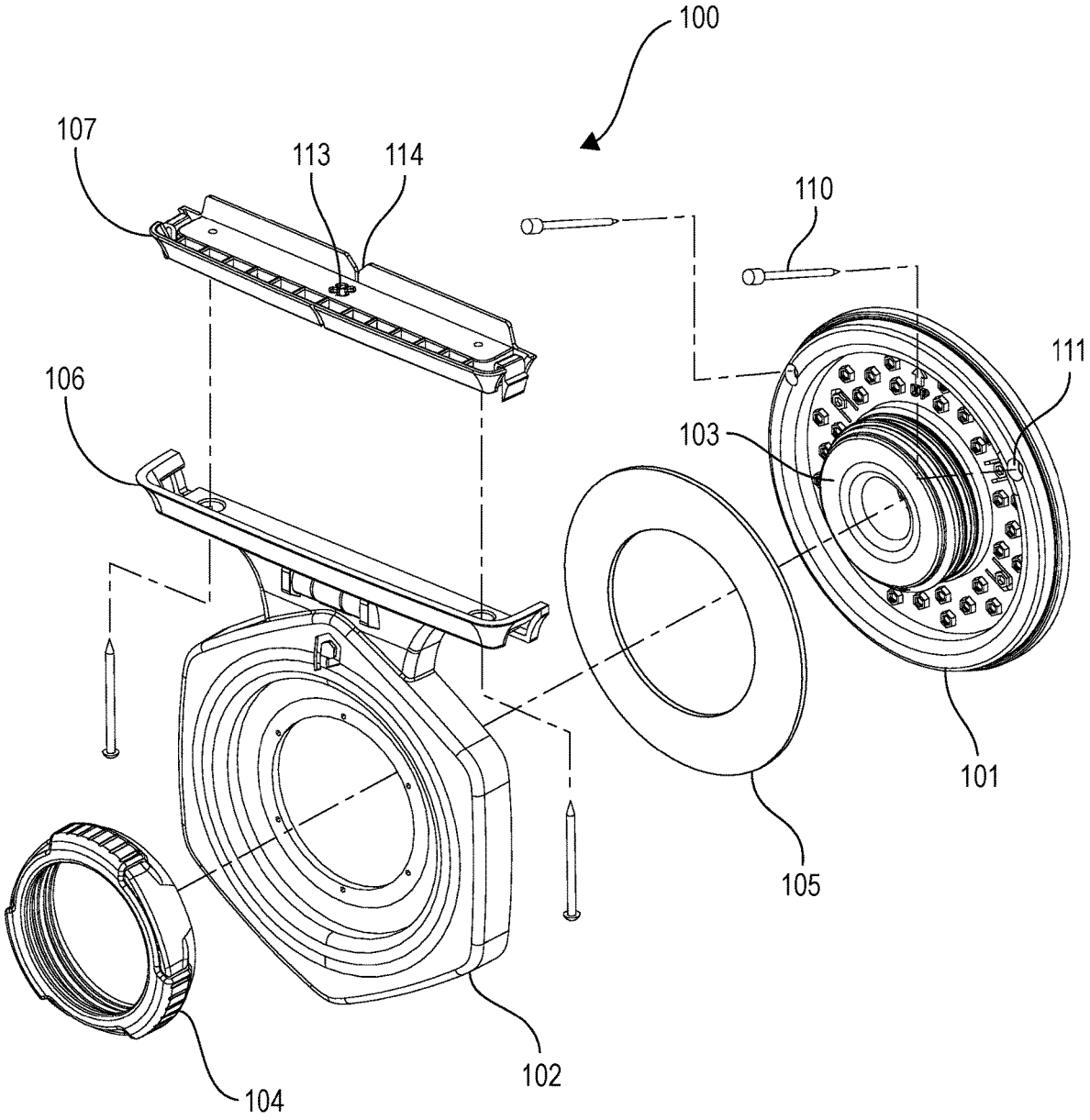
FIG. 2 is an exploded perspective view showing an embodiment of the mounting device of the present invention.
Figure 4:
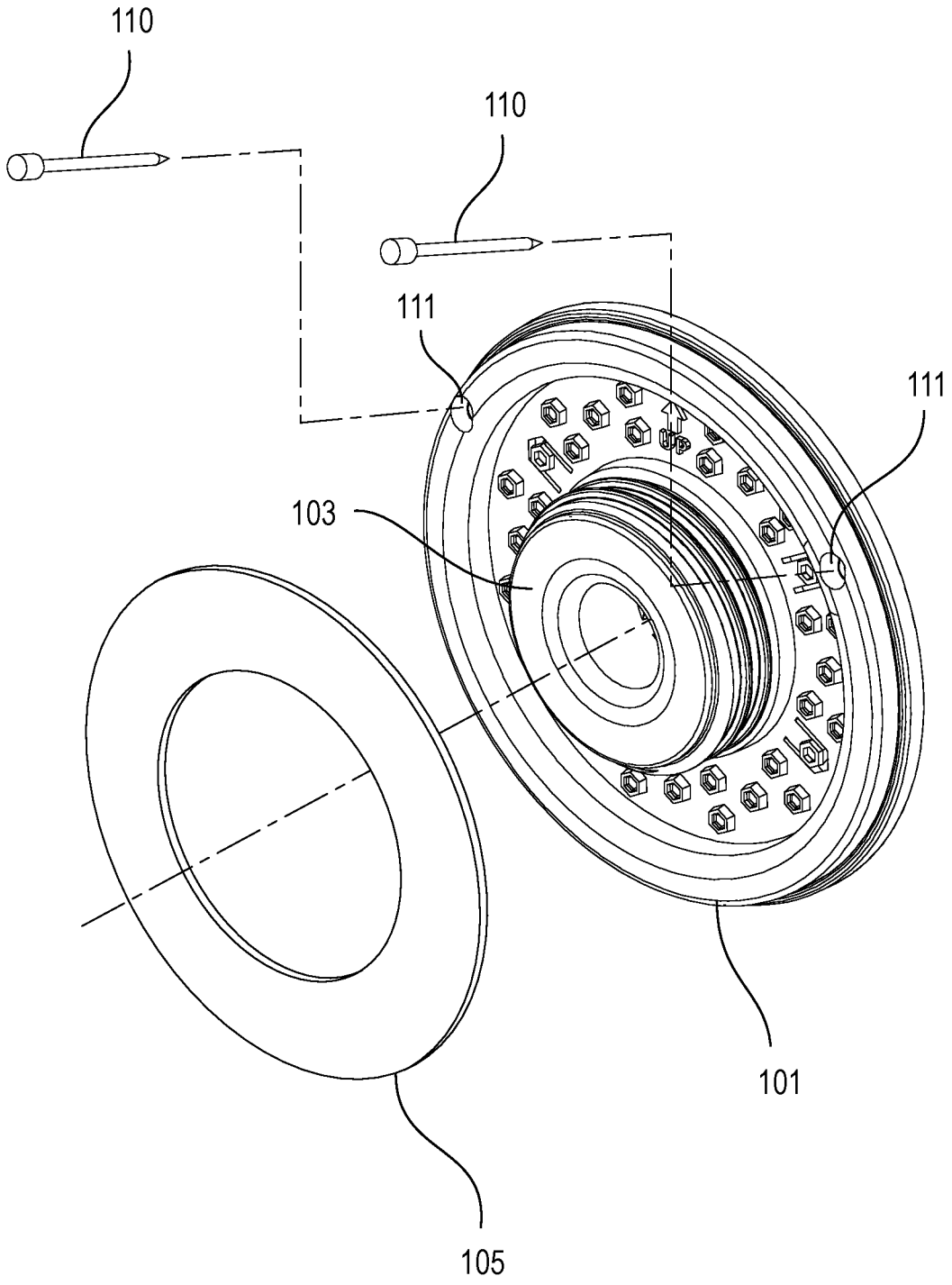
FIG. 4 is a perspective front view of an embodiment of a mounting plate for the mounting device of the present invention.
Figure 5A:
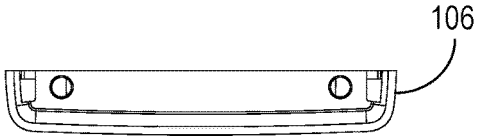
FIGS. 5*a* to 5*f* show a top view, a front view, a side view, a back view, a back perspective view, and a front perspective view of an embodiment of a mounting bracket for the mounting device of the present invention.
Figure 5B:
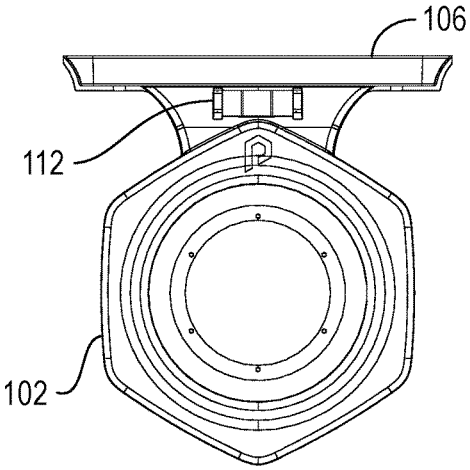
Figure 5C:
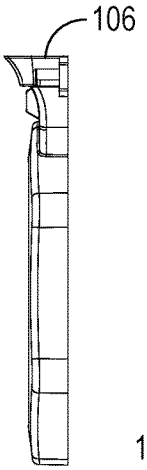
Figure 5D:
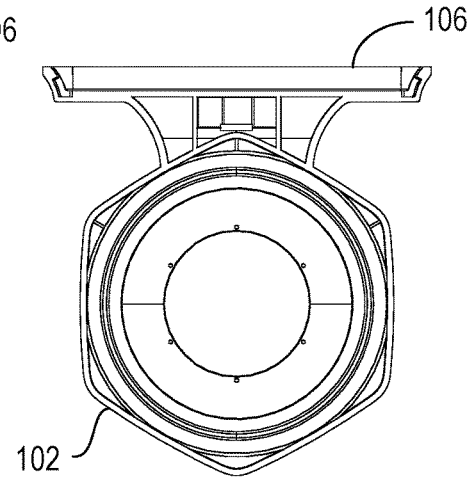
Figure 5E:
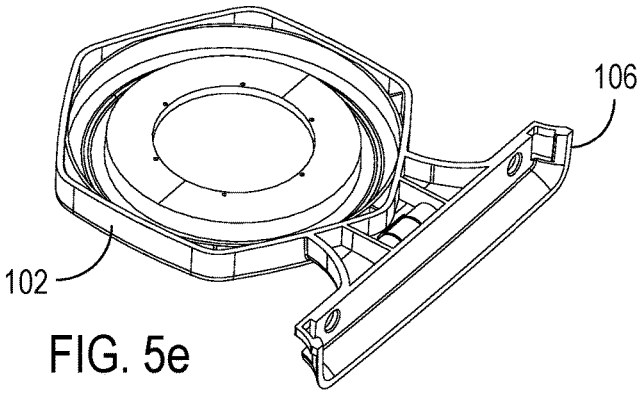
Figure 5F:
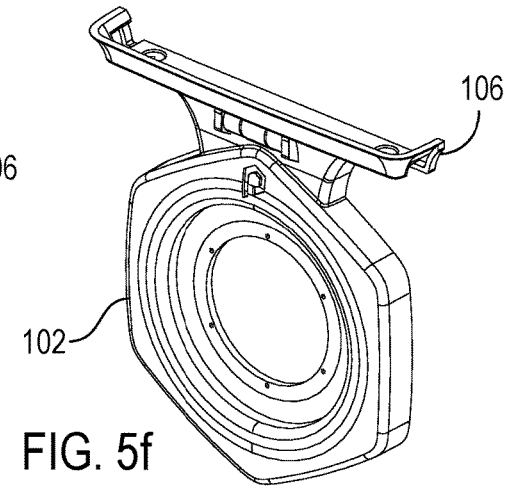
Figure 6A:
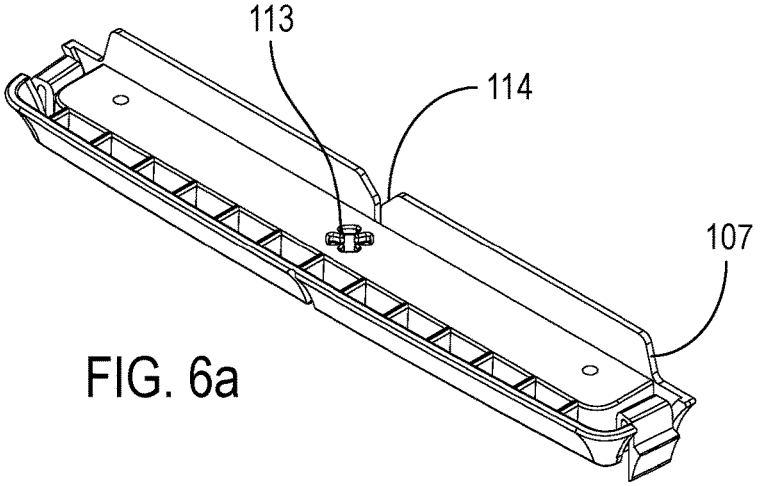
FIGS. 6*a* to 6*e* show a bottom view, a front view, a side view, a top view, and a back view of an embodiment of a mounting interface for the mounting device of the present invention.
Figure 6B:
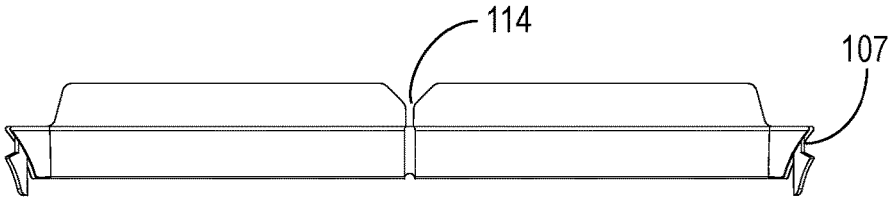
Figure 6C:
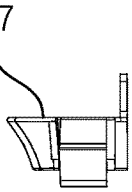
Figure 6D:
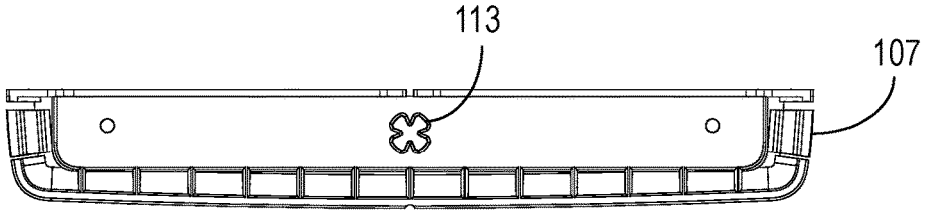
Figure 6E:
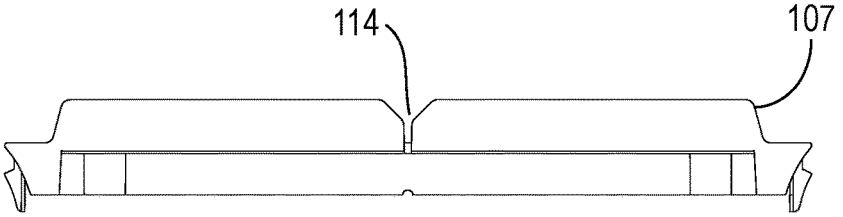

In the embodiment of the mounting plate 101 depicted in FIGS. 2, 3 and 4, the mounting plate 103 is removably affixed to a wall or other mounting surface by adhesive means. The embodiment also allows for the use of fasteners 110 such as nails or screws that are placed through openings 111 in the mounting plate 101 and into the mounting surface. A fastener may also be placed into the mounting surface through the bulls-eye like opening 108. The use of fasteners reinforces the attachment of the mounting plate 101 to the mounting surface and increases the weight of the framed image that can be supported by the mounting device 100.

In the embodiment shown in FIGS. 2 and 4, a rubber gasket 105 is placed between the mounting plate 101 and the mounting bracket 102 to prevent the mounting bracket 102 from rotating accidentally or inadvertently around the mid-section 103 of the mounting plate 101 after being coupled to the mounting plate 101 and secured using the retaining nut 104. Other tactile materials, such as plastic, cloth or metal, may be used to create friction between the mounting plate 101 and the mounting bracket 102 to prevent movement. Friction to prevent movement of the mounting plate 102 may also be created using known mechanical means.

In other embodiments of the present invention, the mounting plate 101 and the mounting bracket 102 are fixedly coupled together to form as single component. In such embodiment, the mounting bracket 102 cannot rotate or move on the mounting plate 101 and thus there is no need for a frictional means 105 to prevent movement.

FIGS. 5*a* to 5*f* show an embodiment of the mounting bracket 102 of the present invention and the receptacle 106 formed at the top of the mounting bracket 102. In this embodiment, the mounting bracket 102 includes a vial level 112 for leveling the mounting bracket 102 as it is secured onto the mounting plate 101. Other known means for leveling the mounting bracket 102 may also be used.

In an embodiment of the present invention, the receptacle 106 as shown in FIGS. 5*a* to 5*f*, is engineered to receive, and create a mechanical connection with, the mounting interface 107.

In an embodiment shown in FIGS. 6 and 7, the mounting interface 107 is removably affixed to the frame 115 of the framed image 116 using known adhesives or mechanical means, such as fasteners. The mounting interface 107 is affixed at the back of the framed image 116 at the top of the frame 115 and on the edge or lip 118 formed by the underside of the frame 115. The mounting interface 107 is affixed at the center 119 of the frame 115 from left 120 to right 121. In the embodiment presented in FIGS. 6*a* to 6*e*, the mounting interface 107 has a bulls-eye like opening 113 and/or a notch 114 at the center for ease in locating the mounting interface 107 at the center 119 of the frame 115.

Figure 8:
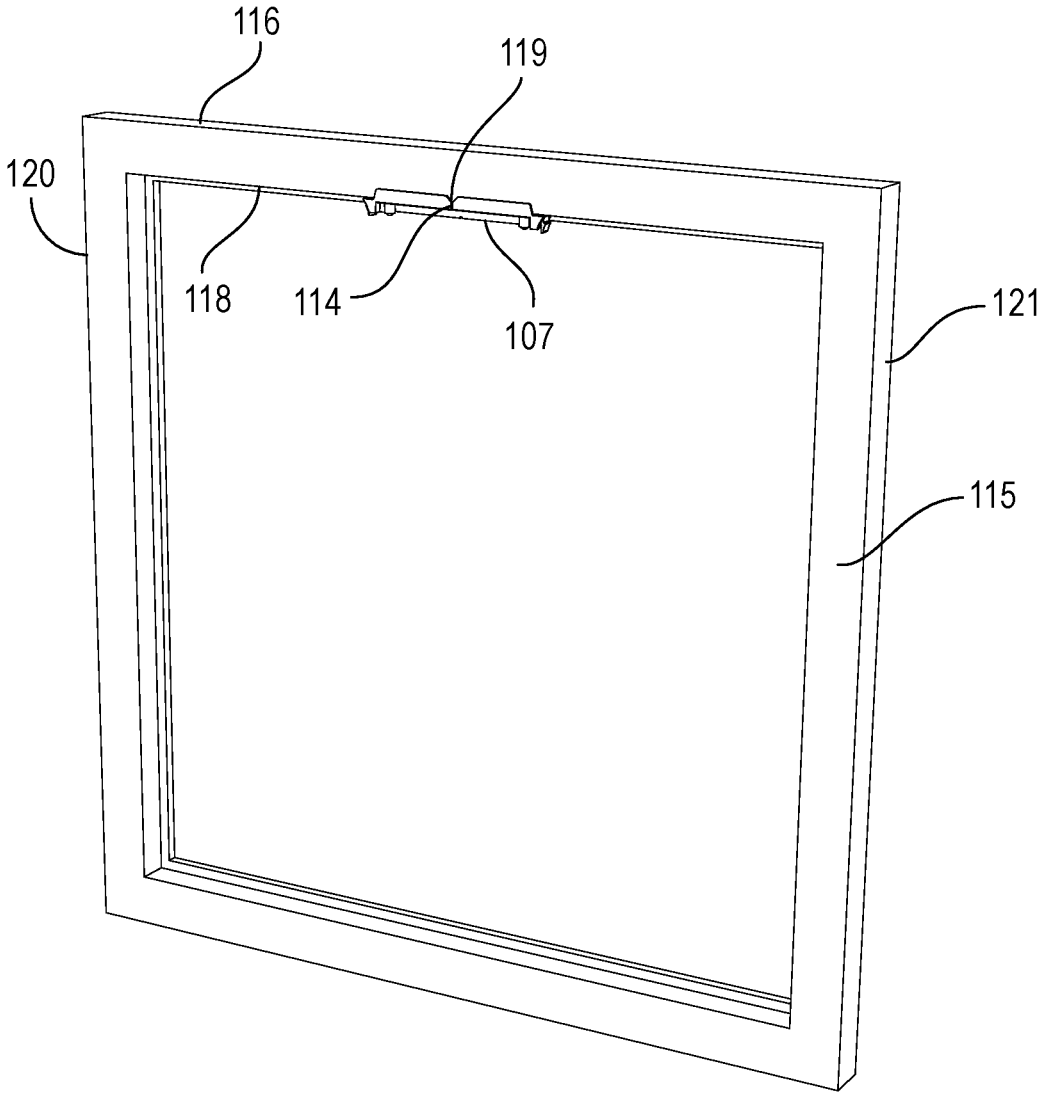
FIG. 8 is a perspective view of the back of a framed image showing an edge or lip formed by the frame and a mounting interface affixed at the center of the top back edge of the frame of the framed image.

FIG. 8 shows the mounting interface 107 removably affixed to the top back edge 118 of the frame 115 of the image 116. The mounting interface 107 is affixed at the center 119 of the frame 115 from left 120 to right 121. The mounting interface 107 has a notch 114 at the center for ease in locating the mounting interface 107 at the center 119 of the frame 115.

Figure 9:
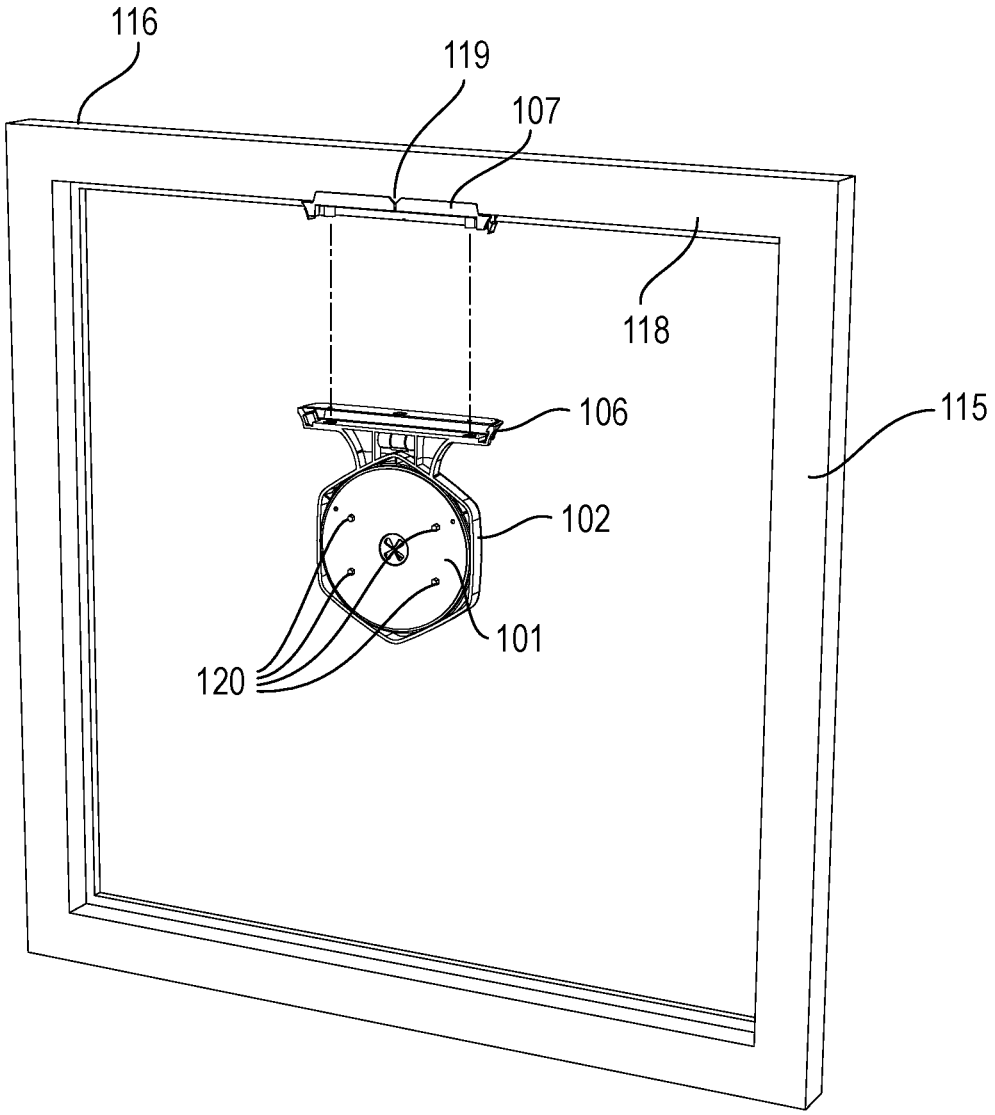
FIG. 9 is a perspective view of the back of a framed image showing an edge or lip formed by the frame, a mounting interface affixed at the center of the top back edge of the frame of the framed image, and the mounting bracket for receiving the mounting interface.

FIG. 9 shows an embodiment of the present invention with the mounting interface 107 removably affixed at the center 119 of the top back edge 118 of the frame 115 of the image 116 and also shows the back of the mounting bracket 102 and the receptacle 106 into which the mounting interface 107 is placed when mounting the framed image 116 onto a wall or other surface.

The embodiment in FIG. 9 also shows a plurality of standoffs 120 at the back of the mounting plate 101. In an embodiment that utilizes the adhesive to removably affix the mounting plate 101 to a mounting surface, the standoffs 120 prevent adhesion until the mounting plate 101 is properly oriented on the mounting surface and the mounting plate 101 is pressed onto to the mounting surface, causing the standoffs 120 to recede, flex, and/or breakaway. In embodiments where the mounting plate 101 and the mounting bracket 102 are fixedly coupled together, standoffs 120 may be used to level the mounting device 100 before removably affixing it to the mounting surface.

The mounting device 100 of the present invention allows a framed image to be mounted flush to the mounting surface. The terms "flush" or "flush to the mounting surface" as used herein means that all backside surfaces of the frame for the framed image are parallel to and touching or nearly touching the mounting surface. When using the mounting device 100 of the present invention, a framed image will be level and secure on the mounting device 100 when the mounting bracket 102 is level on the mounting surface and the interface 107 is placed into the receptacle 106 on the mounting bracket 102.

The mounting device 100 of the present invention can be used to mount any framed image, including canvas images, paintings, artwork, prints, photographs, wall hangings, or other images that have a lip or edge 118 on the back, top of the framed image 116 onto which the mount interface 107 may be affixed.

What is claimed is:

1. A device for mounting a framed image flush onto a mounting surface, the device comprising a mounting plate that defines an opening for placing the mounting plate over a predetermined mark on the mounting surface, a means for removably affixing the mounting plate to the mounting surface, a mounting bracket that fits onto the mounting plate, wherein the top of the mounting bracket comprises a receptacle, a means for removably coupling the mounting bracket to the mounting plate, a means for leveling the mounting bracket and the receptacle as the mounting bracket is coupled to the mounting plate, a frictional means for preventing the mounting bracket from moving once coupled to the mounting plate, a mounting interface that is configured to be removably affixed to a horizontal member of a frame of the framed image, and a means for removably affixing the mounting interface into the receptacle, wherein the means for removably coupling the mounting bracket to the mounting plate comprises a mounting plate with a threaded mid-section forming a male screw and a retaining nut that is screwed onto the threaded mid-section of the mounting plate for removably coupling the mounting bracket and mounting plate.

2. The device of claim 1 wherein the means for removably affixing the mounting plate to the mounting surface is an adhesive, an adhesive strip or adhesive tape.

3. The device of claim 1 wherein the means for providing friction between the mounting bracket and mounting plate is one of a rubber, cloth, plastic, or metal gasket placed between the mounting plate and the mounting bracket.

4. The device of claim 1 wherein the means for leveling the mounting bracket and receptacle is a vial level fixedly attached to the mounting bracket.

5. The device of claim 1 wherein the means for leveling the mounting bracket is a vial level removably attached to the mounting bracket.

6. The device of claim 1 wherein the means for removably affixing the mounting interface into the receptacle is a mechanical connection between the receptacle and the mounting interface.

7. The device of claim 6 wherein the mechanical connection is one or more interconnecting clips machined into the receptacle and the mounting interface.

* * * * *